US006827629B2

(12) United States Patent
Kim et al.

(10) Patent No.: US 6,827,629 B2
(45) Date of Patent: Dec. 7, 2004

(54) METHOD OF AND APPARATUS FOR CONTROLLING THE CHEMICAL MECHANICAL POLISHING OF MULTIPLE LAYERS ON A SUBSTRATE

(75) Inventors: Dea-Yun Kim, Suwon-si (KR); Jae-Won Hwang, Suwon-si (KR); Eun-Ju Kang, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/726,650

(22) Filed: Dec. 4, 2003

(65) Prior Publication Data

US 2004/0111175 A1 Jun. 10, 2004

(30) Foreign Application Priority Data

Dec. 6, 2002 (KR) ..... 2002-77286

(51) Int. Cl.[7] ..... B24B 49/00

(52) U.S. Cl. ..... 451/5; 451/57; 451/65

(58) Field of Search ..... 451/5, 8, 57, 65

(56) References Cited

U.S. PATENT DOCUMENTS 6,171,174 B1 * 1/2001 Campbell et al. ..... 451/5
6,213,848 B1 * 4/2001 Campbell et al. ..... 451/41
6,350,179 B2 * 2/2002 Campbell et al. ..... 451/41

* cited by examiner

*Primary Examiner*—Dung Van Nguyen
(74) *Attorney, Agent, or Firm*—Volentine Francos & Whitt, PLLC

(57) ABSTRACT

A polishing system controls the durations over which different layers on a substrate are sequentially polished. The polishing system polishes an upper layer using an endpoint detection technique and polishes a lower layer using a closed loop control technique. Once the lower layer is detected during the course of polishing the upper layer, the polishing system automatically enters the recipe for polishing the lower layer under a closed loop control mode.

10 Claims, 5 Drawing Sheets

METHOD OF AND APPARATUS FOR CONTROLLING THE CHEMICAL MECHANICAL POLISHING OF MULTIPLE LAYERS ON A SUBSTRATE

BACKGROUND OF THE INVENTION

1. Field of the Invention

The present invention relates to chemical mechanical polishing. More particularly, the present invention relates to controlling the time during which multiple layers on a substrate are chemically mechanically polished.

2. Description of the Related Art

Endpoint detecting (EPD) and closed loop control (CLC) have each been used individually to establish the point in time at which the chemical mechanical polishing (CMP) of a target layer on substrate is terminated.

There are several techniques that are used for EPD, such as an optical technique, a motor current control technique (in which variations in the motor current caused by the friction produced by different layers are detected), and a non-contact current technique.

As an example of a CMP system employing the optical endpoint detecting technique, the AMAT Mirra CMP system of Applied Materials, Inc. includes a light source that illuminates the target layer, a detector, and a mirror which directs beams of light reflected from the layer being polished to the detector as an optical signal. The detector converts the optical signal to an electrical signal (endpoint detection signal), and monitors for changes in the signal which occur when the polishing process progresses to a layer underlying the target layer. Hence, the endpoint of the chemical mechanical polishing process is detected. With respect to this technique, the intensity of the beams of light reflected from the layers is proportional to the reflectance of the layers. Accordingly, the above-described technique is well-suited for the chemical mechanical polishing of a metal layer, i.e., a layer having a high reflectance.

When multiple layers are chemically-mechanically polished using the optical endpoint detecting method, there are as many variations in the electric endpoint detection signal as there are layers. Accordingly, the processing algorithm is complex and it is difficult to implement a suitable control method.

FIG. 1 illustrates a relationship between an endpoint detection signal (ISRM) and layers being polished when the AMAT Mirra CMP system is used to form a shallow trench isolation (STI) structure on a wafer. As this figure shows, an error in the control occurs during a polishing period ΔT. The period ΔT elapses between the time T at which the endpoint of a layer (e.g., an SiN layer in the STI structure) is detected and an endpoint detection position of a practical layer. To deal with this error, the wafers must be checked by lot or sheet unit before they are subsequently processed.

The motor current control method also suffers from the above-described problems and limitations. After one layer of a 2-layered structure is polished, the polishing of the other layer can be performed only by time control when using the motor current control method, similar to the optical endpoint detecting method. Accordingly, the motor current control method cannot cope with changes in the polishing rate and variations in the thickness of the other layer of the 2-layered structure.

The closed loop control endpoint detection method is a type of trial-and-error method in which subsequent processes are controlled according to information collected from the previous processes. The closed loop control method can be classified as a sheet unit control method or a lot unit control method. A polishing process using the closed loop control method will now be described with reference to FIG. 2.

First (step S20), a CLC manager measures pre-polished thickness data (pre TOX) using a corresponding lot of wafers and stores the data in a database (not shown). Next (step S30), the CLC manager calculates the polishing time necessary to attain the optimized polishing thickness. The CMP process is carried out for a duration corresponding to the calculated polishing time (step S40). Post-polishing thickness data (post TOX) is then measured (step S50), and the polishing rate is calculated using the pre TOX and the post TOX. In the lot unit wafer process, the polishing time for a current CMP process is set by dividing a difference between the pre TOX and the target value by the polishing rate calculated at the end of the previous CMP process.

Also, the measured thickness data is compared to process specifications (step S60). If the measured thickness data deviates from the process specifications, a statistical process is preformed during which time a pause in the CMP process takes place (step S70). In this case, an operator must take immediate action, such as changing the polishing pad. The polishing time is recalculated after the polishing pad is changed or the problem is otherwise dealt with.

The above-described CLC method can be readily applied to a CMP process for polishing a single layer. However, it is difficult to apply the CLC method to a CMP process for polishing a 2-layered structure, such as an STI structure, because the polishing rate differs among the layers constituting the 2-layered structure.

Accordingly, the chemical mechanical polishing of a 2-layered structure necessitates a complex control method and lots of processing time. As previously described, it is difficult to execute a satisfactory polishing time control when a 2-layered structure is polished by a conventional CMP system relying on an optical endpoint detection method. Therefore, samples must be constantly checked, i.e., additional processes must be employed. The closed loop control method can not be used exclusively in a CMP process for polishing a 2-layered structure, such as an STI, because the polishing rates of the two layers constituting the 2-layered structure are different from each other.

SUMMARY OF THE INVENTION

An object of the present invention is to provide a polishing system and method which can effectively control the times during which different layers of a multi-layered structure are polished.

According to one aspect of the present invention, a system for controlling the polishing times of different layers on a semiconductor wafer includes a chemical mechanical polishing (CMP) apparatus, a measuring apparatus for measuring pre-polishing thickness and post-polishing thickness of the layers polished by the CMP apparatus, a database for storing the pre-polishing thickness and post-polishing thicknesses that are measured by the measuring apparatus, an endpoint detection system for controlling the CMP apparatus to operate in an endpoint detection mode, a closed loop control (CLC) manager for receiving the thickness data from the measuring apparatus, calculating a polishing time based on the thickness data, and controlling the CMP apparatus to operate in a closed loop control mode, and an operator interface by which the CMP apparatus is selectively operated in the endpoint detection mode and the closed loop control mode.

For instance, the operator interface allows an operator to input the recipes of the polishing processes carried out under the endpoint detection and closed loop control modes. The operator interface may also or alternatively allow the operator to monitor the progression of the polishing process.

The system may polish semiconductor wafers by lot or by sheet unit. The endpoint detection system may be an optical endpoint detection system or a motor current control feedback system.

In any case, once the CMP apparatus completes the polishing of an upper layer as confirmed by the endpoint detection system, the operator interface receives control information from the CLC manager and automatically inputs a recipe containing a set value, i.e., a polishing time, by which the CMP apparatus polishes the lower layer under the control of the CLC manager.

Therefore, according to another aspect of the invention, a process for polishing a multi-layered structure basically includes a first step of preparing process recipes for the polishing of upper and lower target layers of the structure, a second step of polishing the upper target layer using an endpoint detecting technique, and a third step of polishing the lower target layer using a closed loop control technique.

Thus, the substrate is monitored while the upper target layer is being polished. Once the upper layer is completely polished as confirmed by endpoint detection (the detection of the state in which the lower target layer is exposed), the thickness of the lower target layer is measured. A polishing time is calculated based on the measured thickness of the lower target layer. The lower target layer is then polished according to the calculated polishing time. Specifically, the polishing time is calculated using empirical data derived from each time the CMP apparatus is used to polish a lower target layer. In this case, the empirical data is preferably weighted according to the sequence in which it is derived.

BRIEF DESCRIPTION FO THE DRAWINGS

DETAILED DESCRIPTION OF THE PREFERRED EMBODIMENTS

Figure 1:
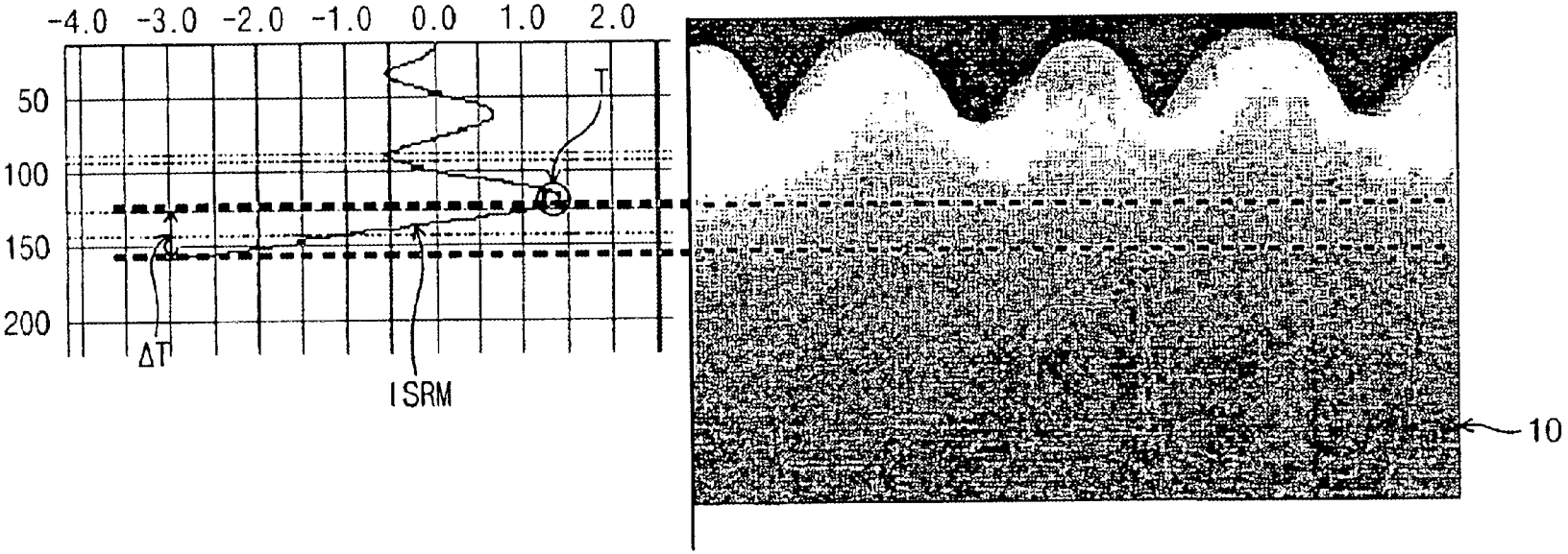
Fig. 1 (PRIOR ART)
FIG. 1 shows a relationship between an endpoint detection signal and layers on a substrate in an optical endpoint detection method of a CMP process that is being used to form a typical STI.
Figure 2:
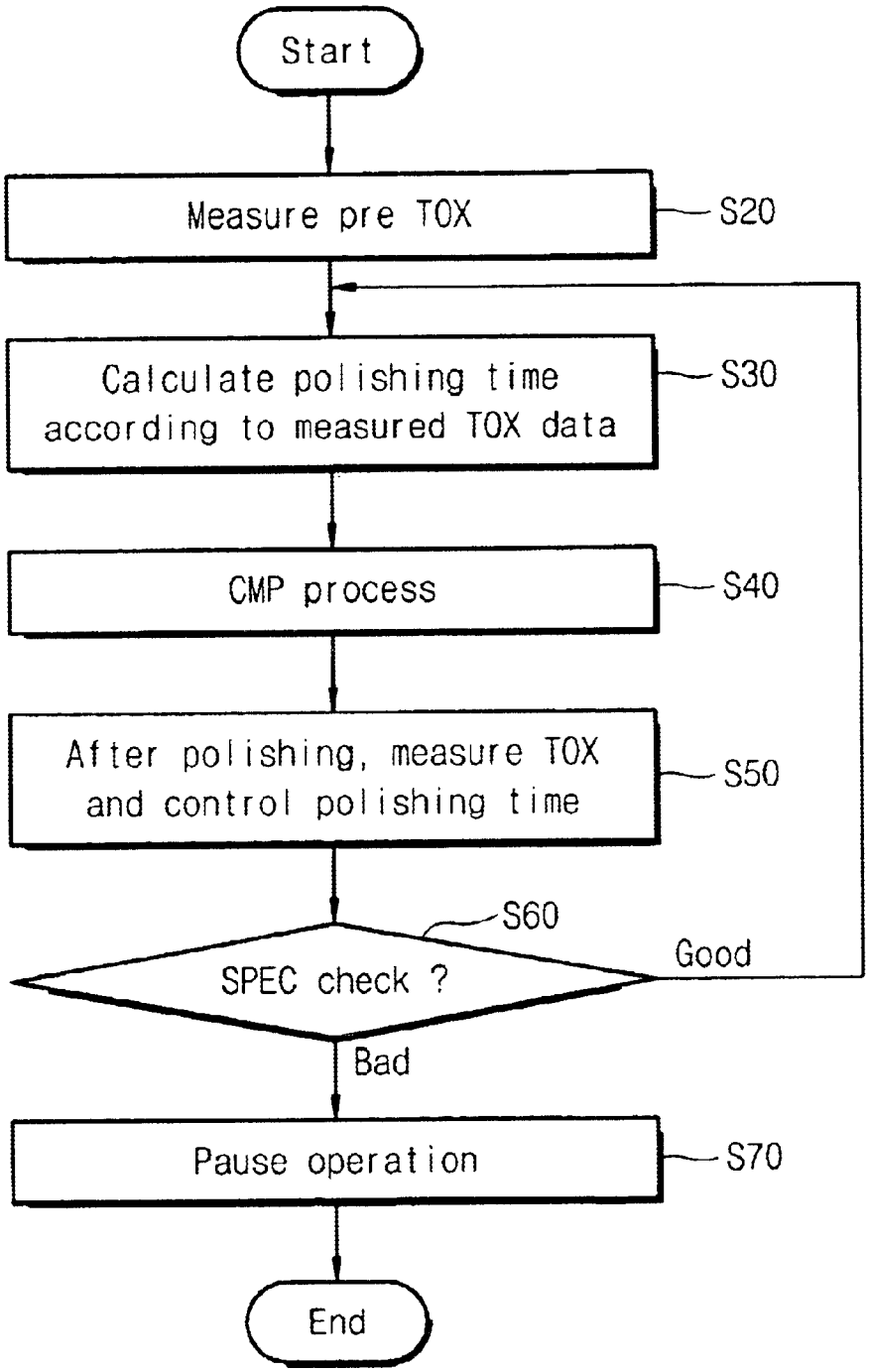
Fig. 2 (PRIOR ART)
FIG. 2 is a flowchart of a typical closed loop control method of a CMP process.
Figure 3:
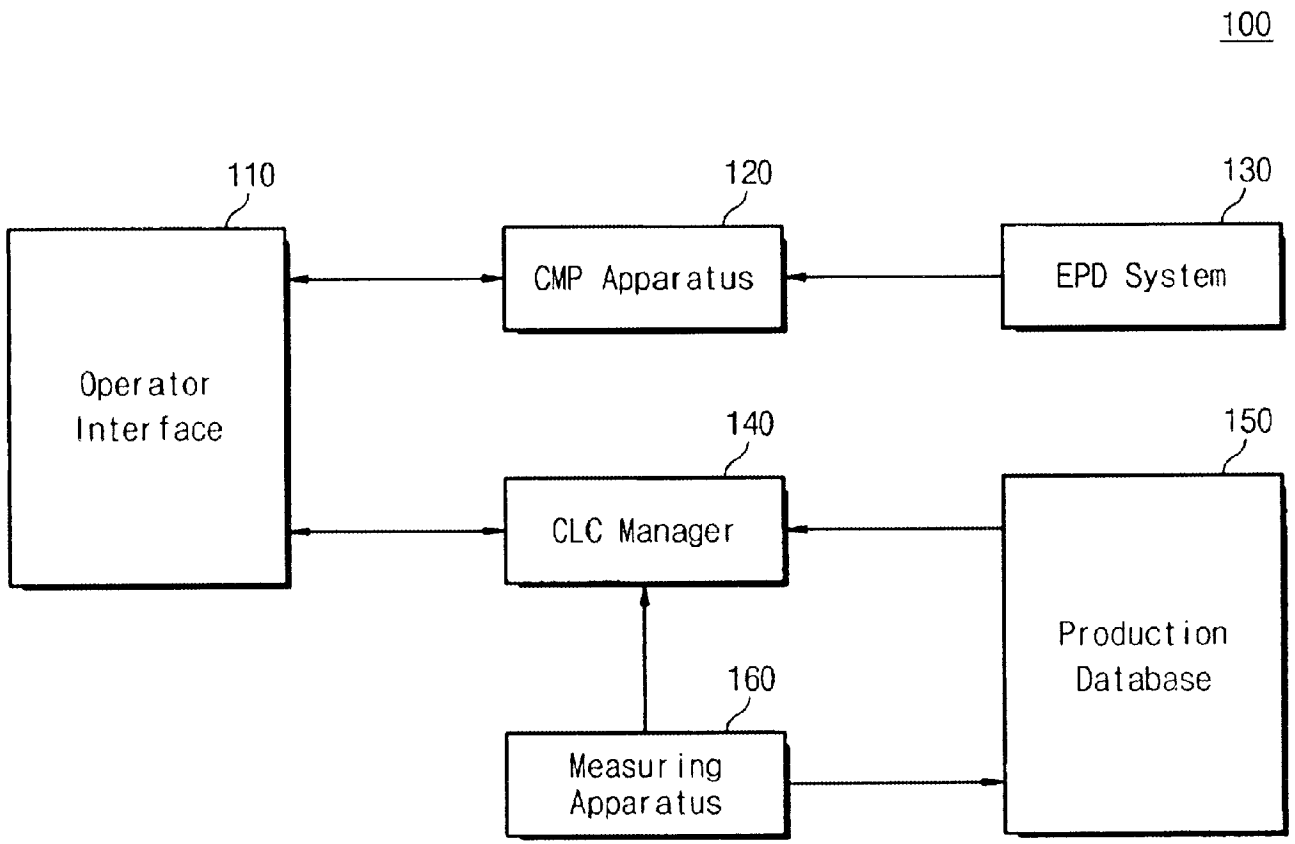
FIG. 3 is a block diagram of a CMP control system for controlling the polishing of a multi-layered structure, according to the present invention.

A polishing control system for controlling the polishing of a multi-layered structure, according to the present invention, will now be described with reference to FIG. 3. The polishing control system 100 includes an operator interface 110, a CMP apparatus 120, an endpoint detecting (EPD) system 130, a closed loop control (CLC) manager 140, a production database 150, and a measuring apparatus 160.

The operator interface 110 has typical computer system components (e.g., a central processing unit (CPU), an input device, a display device, a memory device, etc.) that allow an operator to input set data based on a process recipe or to monitor the progression and results of a polishing process.

The CMP apparatus 120 polishes wafers by lot or sheet unit. The CMP apparatus 120 receives control information, e.g., the polishing time, from the EPD system 130 and the CLC manager 140, prior to polishing each of the different layers on the wafer(s).

The EPD system 130 controls the polishing time of the CMP apparatus 120 using the endpoint detecting method.

The CLC manager 140 conducts a data communication with the operator interface 110, controlling the CMP apparatus 120 to perform a polishing process using the closed loop control method. That is, the CLC manager 140 receives data from the measuring apparatus 160, calculates the polishing time based on the data, and issues a signal representative of the calculated polishing time to the operator interface 110. The operator interface 110 issues a command to the CMP apparatus 120 that causes the apparatus to effect a polishing operation for the polishing time.

The production database 150 stores data corresponding to process recipes of layers in accordance with a wafer fabricating process. The production database 150 provides the stored data to the CLC manager 140.

The measuring apparatus 160 is an apparatus (known per se) for measuring the thicknesses of the respective layers. The measuring apparatus 160 measures pre-polishing thickness and post-polishing thickness, transmits data representing the measured values to the production database 150, and transmits data representing the measured values to the CLC manager 140 as well.

The polishing control method according to the invention will be described in detail below with reference to the flowchart of FIG. 4. The control method is implemented using a control program that is stored in the operator interface 110 and the CLC manager 140. Furthermore, the method will be described as applied to an STI CMP process as just one example. In this figure, S1 designates steps constituting an endpoint detecting method and S2 designates steps constituting a closed loop control method.

Figure 4:
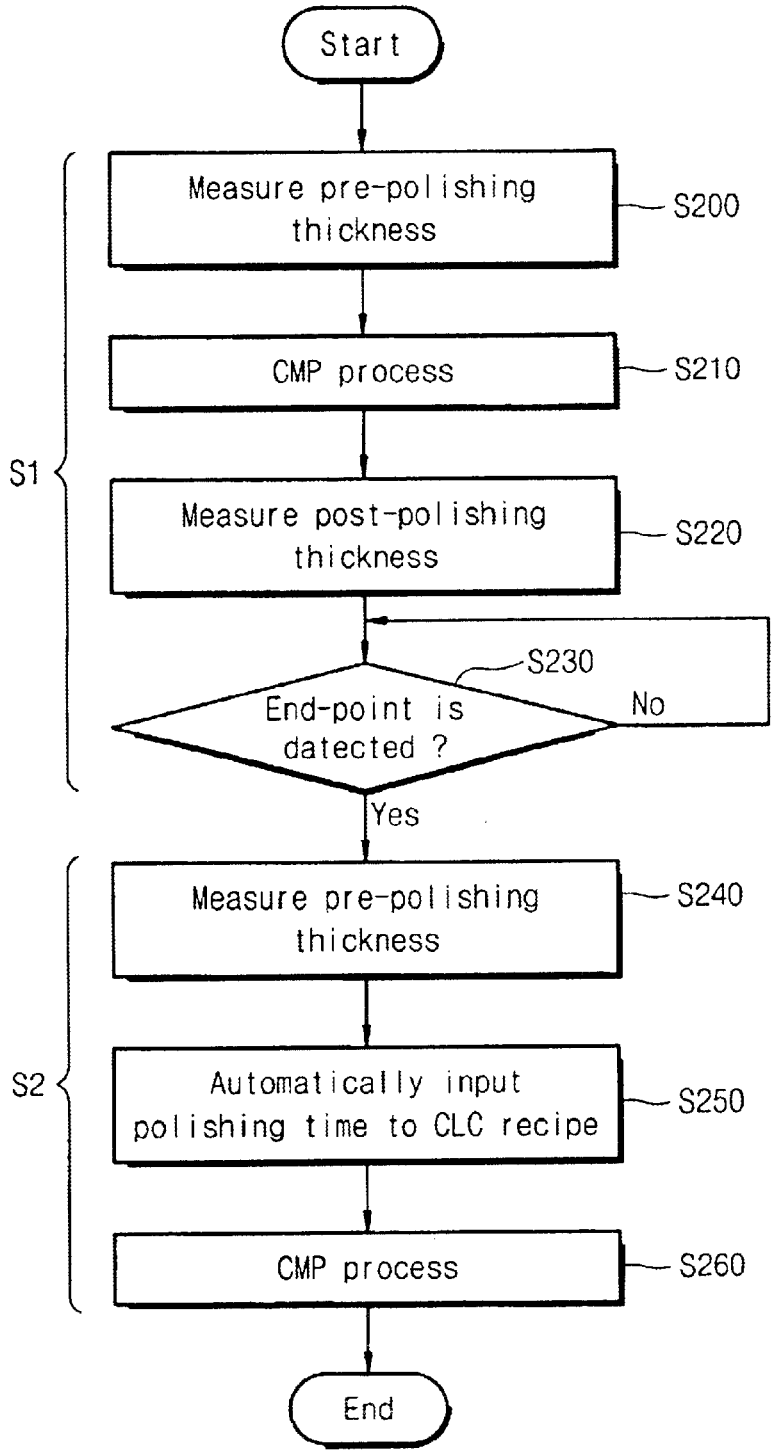
FIG. 4 is a flowchart of the control method implemented by the polishing control system shown in FIG. 3.

Referring now to FIG. 4, first, the pre-polishing thickness (Pre Tsin) of the upper layer is measured (step S200) using the measuring apparatus 160. A polishing process is then carried out (step S210) based on the measured thickness. Subsequently, a check is made to determine whether the endpoint of the polishing process has been detected (step S230). That is, it is determined as to whether the upper layer has been polished to such an extent that the lower layer is exposed. If the endpoint of this first CMP process is detected, the routine proceeds to S2 in which the lower layer is polished under the CLC method.

That is, the pre-polishing thickness of the lower layer is measured (step S240). Then the polishing time corresponding to the measured pre-polishing thickness is calculated and is provided to the operator interface 110 (step S250), whereby the polishing time according to the CLC recipe is automatically inputted to the CMP apparatus 120. The CMP process is carried out on the lower layer (step S260) according to the inputted polishing time.

Thus, the polishing time is controlled in different ways throughout the course of the polishing of the multi-layered structure, namely, the STI structure. Specifically, the polishing time required for polishing an oxide layer to expose the underlying nitride (SiN) layer is established by the EPD system 130. The SiN polishing is controlled by the CLC manager 140 in connection with the operator interface 110. Thus, the two systems operate together to optimize the time for the STI CMP process. As a result, the process produces uniform results, and the process is relatively simple because it requires relatively few steps. Also, such an application of the present invention is advantageous in that the time at which the SiN is exposed is correctly detected, and the CLC system is properly initialized to deal with various thicknesses of the SiN that the CMP apparatus may encounter.

Table 1 below is displayed by the operator interface 110. The table shows the present invention as applied to the polishing of wafers by lot, wherein first and second lots LOTID represent sample data. Removal rate data and specific weight are used to calculate an optimized removal rate (R/R). Accordingly, it is possible to obtain the optimal polishing time.

TABLE 1

| LOTID | Pre TOX | Post TOX | P/T | P/T | SPEC | R/R | LOGIC |
|---|---|---|---|---|---|---|---|
| 1 | 1501 | 1078 | 0 | 39 | 1070 | 10.85 | — |
| 2 | 1523 | 1069 | 42 | 42 | 1070 | 10.82 | RR = 10.85 |
| 3 | 1469 | 1083 | 37 | 37 | 1070 | 10.44 | RR = 10.85 |
| 4 | 1487 | 1079 | 38 | 38 | 1070 | 10.75 | RR = 10.85 |
| 5 | 1482 | 1068 | 38 | 38 | 1070 | 10.89 | RR = 0.7*10.82 + 0.3*10.85 |
| 6 | 1492 | 1104 | 40 | 40 | 1070 | 9.71 | RR = 0.5*10.44 + 0.3*10.82 + 0.2*10.85 |
| 7 | 1513 | 1097 | 41 | 41 | 1070 | 10.15 | RR = 0.5*10.89 + 0.3*10.44 + 0.2*10.82 |
| 8 | 1493 | 1095 | 39 | 39 | 1070 | 10.19 | RR = 0.5*10.89 + 0.3*10.75 + 0.2*10.44 |

*P/T = Polishing Time,
SPEC = Specification

In particular, the CMP system 100 sets the polishing rate giving weight to the data based on empirical values. For example, the polishing rate is calculated by giving the newest data 50% weight and giving the next sets of data 30% and 20% weight, respectively.

More specifically, when the STI CMP is performed by the Mirra CMP system of the AMAT, wafers constituting a first lot are chemically mechanically polished for a predetermined time. The thickness of the respective polished layers is divided by the polishing time to yield the amount of material removed per unit time, i.e., the polishing rate of a corresponding layer. The calculated polishing rate is designated as a first empirical value. Afterwards, when wafers constituting the next lot are polished, the difference between a previous step polishing thickness and a target polishing thickness is divided by the first empirical value. The result is designated as a second empirical value.

An optimal polishing rate (hereinafter "removal rate") may be obtained using all of the removal rates previously calculated. For this, different weights are given to the rates as set out as per the following equation 1.

$$RR=RR_{(n)}*f1+RR_{(n-1)}*f2+RR_{(n-2)}*f3 \quad \text{[Equation 1]}$$

wherein $RR_{(n)}$, $RR_{(n-1)}$, and $RR_{(n-2)}$ represent removal rates for each of n lots, respectively, and f1, f2, and f3 represent weights assigned to each of the n lots, respectively. For example, the optimal removal rate RR is determined by weighting the removal rates for the (n−2)th, (n−1)th, and nth lots by 20%, 30%, and 50%, respectively.

In a conventional STI CMP process, a layer of oxide, such as a layer of HT-USG (high temperature undoped silicate glass) or HDP, an optical endpoint method is used to precisely detect the exposing of the second layer, i.e., the layer buried beneath the HT-USG or HDP layer. However, it is difficult to accurately establish the endpoint of the second layer using the optical endpoint method, and it is virtually impossible to cope with variations that may occur in the thickness of the second layer. In addition, as the design rule of semiconductor devices becomes smaller and smaller, the thickness of the SiN layers of STI structures of these devices must be made more precise. Thus, the present invention is particularly well-suited to this application by making use of the advantages of both the endpoint detecting method and the CLC method in establishing the respective polishing times of the HT-USG and SiN layers.

Figure 5:
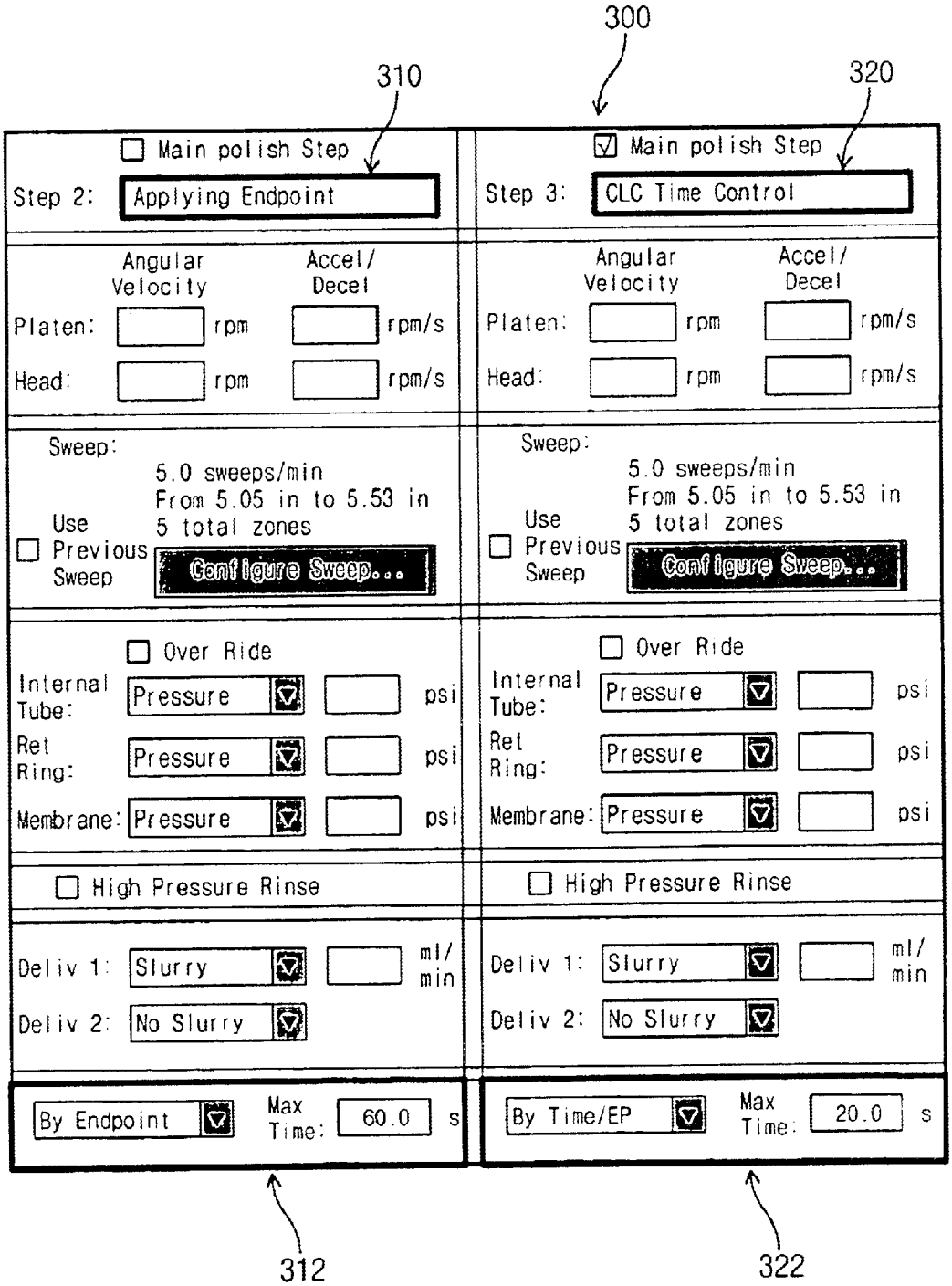
FIG. 5 shows a display screen of a CMP control system for controlling the polishing of a 2-layered structure according to the present invention.

FIG. 5 illustrates a display screen for inputting data concerning the recipe for the polishing of a 2-layered structure according to the invention. The display screen is part of the operator interface 110. Referring to this figure, an upper layer CMP process recipe 310 using an endpoint detecting method, and a lower layer CMP process recipe 320 using a closed loop control method are displayed on a display screen 300. In the polishing process according to the present invention, a ramp-up step is conducted and a CMP process based on the recipe 310 is carried out employing the endpoint detection method. When the polishing of the upper layer is completed according to the upper layer recipe 310, a polishing time 322 is automatically inputted to CMP apparatus for the apparatus to polish the lower layer using the recipe 320 under the closed loop control mode. The present invention can be applied to not only an STI CMP process but also to all CMP processes for polishing a 2-layered structure wherein the polishing rates change. Thus, the present invention can be applied to, for example, a W-CMP process or a pad separating CMP process.

In a W-CMP process for polishing an upper layer made of tungsten (W) and a lower oxide layer, the upper layer is polished while employing a motor current control technique until the lower layer is exposed. The CLC method is then employed to control the polishing of the layer underlying the tungsten layer. On the other hand, in a pad separating CMP process, the optical endpoint method and the CLC method are employed in the polishing of an upper layer made of polysilicon and a lower gate layer made of a nitride (SiN), respectively.

As described above, in a semiconductor wafer polishing process according to the present invention, the polishing times of respective layers is controlled using an endpoint detection technique (optical or motor current technique) and a closed loop control technique carried out through the use of a known measuring apparatus. Accordingly, variations in the thicknesses of the lower layers that the CMP apparatus may encounter can be dealt with effectively, and the polishing process can be carried out with a high degree of accuracy and reproducibility.

Finally, although the present invention has been described herein in accordance with the preferred embodiments thereof, various modifications and substitutions will become readily apparent to those skilled in the art. Accordingly, the preferred embodiments may be so modified and changed without departing from the true spirit and scope of the invention as defined by the appended claims.

What is claimed is:

1. A system for performing a chemical mechanical polishing process, the system comprising:

a chemical mechanical polishing (CMP) apparatus;

a measuring apparatus operable to measure the thickness of a layer on a substrate and generate data indicative of the measured thickness, whereby pre-polishing and post-polishing thicknesses of the layer can be measured;

a database operatively connected to said measuring apparatus so as to store data of the pre-polishing and post-polishing thicknesses measured by said measuring apparatus;

an endpoint detection system operatively connected to said CMP apparatus so as to control said CMP apparatus to operate in an endpoint detection mode wherein a substrate is monitored to detect when a layer underlying an upper targeted polishing layer on the substrate is exposed;

a closed loop control manager operatively connected to said measuring apparatus so as to receive the thickness data from the measuring apparatus, said closed loop control manager having a processor that calculates a polishing time on the basis of the thickness data from the measuring apparatus, and said closed loop control manager operatively connected to said CMP apparatus so as to control said CMP apparatus to operate in a closed loop control mode wherein the polishing of a layer is carried out for said polishing time; and an operator interface operatively connected to said CMP apparatus, said interface directing the CMP apparatus to be selectively operated in said endpoint detection mode under the control of said endpoint detection system, and in said closed loop control mode under the control of said closed loop control manager.

2. The system as recited in claim 1, wherein said interface has an input section by which an operator can input to said CMP apparatus data of process recipes for chemical and mechanical polishing processes carried out when said CMP apparatus is operating in said endpoint detection and closed loop control modes, and a display by which the progression of the polishing process carried out by the CMP apparatus can be monitored.

3. The system as recited in claim 1, wherein the endpoint detection system comprises an optical endpoint detection system that includes a light source for illuminating the target layer, and a detector operable to convert light reflected from the target layer to a corresponding electric signal.

4. The system as recited in claim 1, wherein the endpoint detection system comprises a current motor control detection system.

5. The system as recited in claim 1, wherein said closed loop control manager is operatively connected to said operator interface such that the polishing time is transferred thereto automatically once the endpoint detection system detects that the layer underlying the upper target layer is exposed.

6. A method of a chemically mechanically polishing a semiconductor wafer having different layers disposed thereon one above the other, the polishing method comprising:

(a) polishing an upper target layer on the wafer using a chemical mechanical polishing (CMP) apparatus;

(b) monitoring the semiconductor wafer to detect when the polishing of said upper layer exposes a lower target layer disposed beneath the upper layer;

(c) once the upper layer is completely polished, measuring the thickness of the lower layer;

(d) calculating a polishing time corresponding to the measured thickness of the lower layer; and (e) polishing the lower layer for a time period based on said polishing time.

7. The method as recited in claim 6, wherein the monitoring of the semiconductor wafer comprises illuminating the wafer, and detecting beams of light that reflect from the wafer.

8. The method as recited in claim 6, wherein the monitoring of the semiconductor wafer comprises detecting the amount of current flowing to a motor of the CMP apparatus.

9. The method as recited in claim 6, wherein the calculating of the polishing time is carried out using a totality of empirical data derived each time a lower target layer is polished by the CMP apparatus.

10. The method as recited in claim 9, wherein the calculating of the polishing time comprises assigning respective weights to the empirical data according to a sequence in which the empirical data is derived.

* * * * *